US005958666A

United States Patent [19]

Link et al.

[11] Patent Number: 5,958,666

[45] Date of Patent: Sep. 28, 1999

[54] PHOTOGRAPHIC ELEMENT CONTAINING ANTIFOGGING CYCANINE DYES

[75] Inventors: Steven G. Link; Roger Lok, both of Rochester, N.Y.

[73] Assignee: Eastman Kodak Company, Rochester, N.J.

[21] Appl. No.: 08/926,857

[22] Filed: Sep. 10, 1997

[51] Int. Cl.[6] ..... G03C 1/14

[52] U.S. Cl. ..... 430/583; 430/585

[58] Field of Search ..... 430/588, 581, 430/583, 585

[56] References Cited

U.S. PATENT DOCUMENTS

| | | |
|---|---|---|
| 2,131,038 | 9/1938 | Brooker et al. . |
| 3,930,860 | 1/1976 | Shiba et al. . |
| 3,933,507 | 1/1976 | von Konig et al. . |
| 4,225,666 | 9/1980 | Locker et al. . |
| 4,439,520 | 3/1984 | Kofron et al. . |
| 4,524,128 | 6/1985 | Edwards et al. . |
| 4,622,290 | 11/1986 | Tanaka et al. . |
| 4,643,966 | 2/1987 | Maskasky . |
| 4,818,676 | 4/1989 | Baba et al. . |
| 5,141,845 | 8/1992 | Brugger et al. . |
| 5,180,657 | 1/1993 | Fukazawa et al. . |
| 5,200,308 | 4/1993 | Ohtani et al. . |
| 5,206,126 | 4/1993 | Shimazaki et al. . |
| 5,212,054 | 5/1993 | Tashiro et al. . |
| 5,258,273 | 11/1993 | Ezaki et al. . |

FOREIGN PATENT DOCUMENTS

| | | |
|---|---|---|
| 1085665 | 9/1980 | Canada . |
| 144091 B1 | 11/1988 | European Pat. Off. . |
| 0 391 560 | 10/1990 | European Pat. Off. . |
| 438949 A2 | 7/1991 | European Pat. Off. . |
| 447138 A1 | 9/1991 | European Pat. Off. . |
| 458315 A1 | 11/1991 | European Pat. Off. . |
| 498393 | 8/1992 | European Pat. Off. . |
| 0 710 879 | 5/1996 | European Pat. Off. . |
| 0 773 471 | 5/1997 | European Pat. Off. . |
| 59-9658 | 1/1984 | Japan . |
| 62-6251 | 1/1987 | Japan . |
| 62-254139 | 11/1987 | Japan . |
| 1-244442 | 9/1998 | Japan . |
| 1310750 | 3/1973 | United Kingdom . |
| 1391792 | 4/1975 | United Kingdom . |
| 1410488 | 10/1975 | United Kingdom . |
| 1495048 | 12/1977 | United Kingdom . |
| 1530943 | 11/1978 | United Kingdom . |

*Primary Examiner*—Thorl Chea
*Attorney, Agent, or Firm*—Edith A. Rice

[57] ABSTRACT

A photographic element comprises at least one light-sensitive layer comprising a silver halide emulsion, wherein the silver halide content is less than or equal to 30% silver chloride, and a dye of formula (I) or formula (II):

(I)

wherein the substituents are as defined in the specification.

(II)

wherein the substituents are as defined in the specification.

21 Claims, No Drawings

PHOTOGRAPHIC ELEMENT CONTAINING ANTIFOGGING CYCANINE DYES

FIELD OF THE INVENTION

This relates to photographic element comprising a light-sensitive silver halide layer containing a sensitizing dye that minimizes fog, but retains high sensitivity.

BACKGROUND OF THE INVENTION

Conventional silver halide photography uses silver halide particles as the light sensitive elements. These particles are only sensitive to ultraviolet and blue radiation. In order to make the silver halide sensitive to other wavelengths of the visible and infrared spectrum, sensitizing dyes are adsorbed to the surface of the silver halide particles. In order to enhance the sensitivity of the particles they are treated with so-called chemical sensitizers, such as sulfur compounds and gold compounds. The process of adding chemical sensitizers and dyes is known as chemical and spectral sensitization. It can be done in discreet steps or simultaneously (dye-in-the-finish) sensitization. There is a constant need for ever more sensitive emulsions. In the process of pushing silver halide particles to greater sensitivity through the use of sensitizing agents, it is difficult to achieve high sensitivity to light without introducing "fog" centers. Fog is the unwanted development of crystals which have not been exposed to light.

Fog is often controlled by the addition of emulsion stabilizers or antifoggants, but these materials must compete for the limited grain surface with all of the other addenda and dyes, limiting the total amount of addenda that can be used. It would be advantageous if a sensitizing dye also acted as an emulsion stabilizer and an antifoggant. This would allow higher dye coverage on the surface of the silver halide and less need for additional antifoggants and stabilizers.

U.S. Pat. Nos. 3,930,860 and 3,933,507 describes dyes that are antifogging through the formation of silver complexes, i.e. merocyanines with thiocarbonyl groups. One example of a 5,6-dimethoxybenzothiazole merocyanine is given in the latter reference. U.S. Pat. No. 4,493,520 generally alleges that certain spectral sensitizing dyes can also function as antifoggants or stabilizers. Reference is made to U.S. Pat. No. 3,930,860, discussed above, and U.S. Pat. No. 2,131,038, which discloses quaternary salts containing the nucleus:

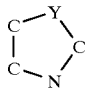

where Y=O, S or Se exert a stabilizing or anti-fogging effect. These compounds are only quaternary salts, not dyes. Therefore they compete for area on the surface of silver halide grains with the dye. With antifogging dyes less of these quaternary salts are needed.

SUMMARY OF THE INVENTION

We have found unexpectedly, that certain spectral sensitizing dyes do act as antifoggants. These dyes give lower levels of fresh fog, and also stabilize the emulsion toward changes as coatings of the emulsion age.

One aspect of this invention is a photographic element comprising at least one light-sensitive layer comprising a silver halide emulsion, wherein the silver halide content is less than or equal to 30% silver chloride, and a dye of formula (I) or formula (II):

(I)

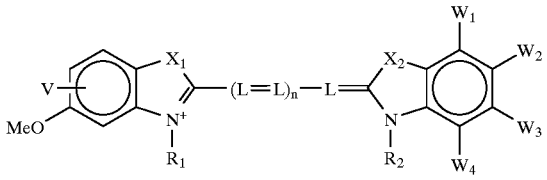

wherein:

each L is a substituted or unsubstituted methine group, n is 0 or 1;

$R_1$ and $R_2$ are substituted or unsubstituted alkyl groups;

V is a 4-methoxy or 6-methoxy group;

$W_1$–$W_4$ are independently hydrogen, alkyl, halogen, aryl, heteroaryl, alkylthio or alkoxy, with the proviso that no more than one of $W_1$–$W_4$ is alkoxy or $W_2$ and $W_3$ or $W_3$ and $W_4$ can be a fused ring; and $X_1$ and $X_2$ are independently S or Se;

(II)

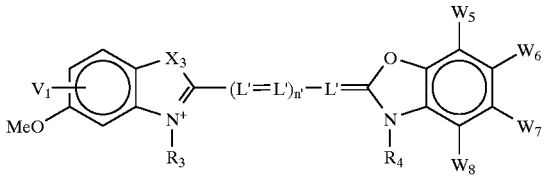

wherein:

each L' is a substituted or unsubstituted methine group, n' is 0 or 1;

$R_3$ and $R_4$ are substituted or unsubstituted alkyl groups;

$V_1$ is a 4-methoxy or 6-methoxy group;

$W_5$–$W_8$ are independently hydrogen, alkyl, halogen, aryl, heteroaryl, alkylthio or alkoxy, with the proviso that no more than one of $W_5$–$W_8$ is alkoxy and if n' is 1, none of $W_5$–$W_8$ is aryl, or $W_6$ and $W_7$ or $W_7$ and $W_8$ can be a fused ring; and $X_3$ is S or Se.

In certain embodiments of the invention the silver halide emulsion comprises at least one additional dye.

ADVANTAGEOUS EFFECT OF THE INVENTION

The invention provides a photographic element in which a silver halide emulsion layer contains a sensitizing dye that not only sensitizes the silver halide but also reduces fog.

DETAILED DESCRIPTION OF THE INVENTION

The photographic element of this invention comprises a photographic element comprising at least one light-sensitive layer comprising a silver halide emulsion, wherein the silver halide content is equal to or less than about 30% silver chloride, and a dye of formula (I) or formula (II):

(I)

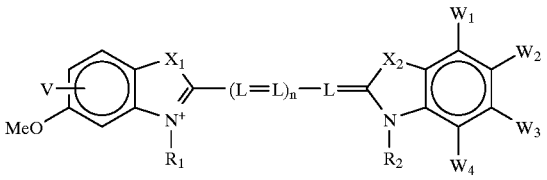

wherein:

each L is a substituted or unsubstituted methine group, n is 0 or 1;

$R_1$ and $R_2$ are substituted or unsubstituted alkyl groups;

V is a 4-methoxy or 6-methoxy group;

$W_1$–$W_4$ are independently hydrogen, alkyl, halogen, aryl, heteroaryl, alkylthio or alkoxy, with the proviso that no more than one of $W_1$–$W_4$ is alkoxy or $W_2$ and $W_3$ or $W_3$ and $W_4$ can be a fused ring; and $X_1$ and $X_2$ are independently S or Se;

(II)

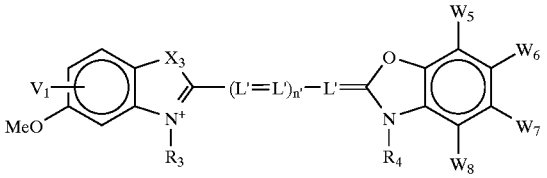

wherein:

each L' is a substituted or unsubstituted methine group, n' is 0 or 1;

$R_3$ and $R_4$ are substituted or unsubstituted alkyl groups;

$V_1$ is a 4-methoxy or 6-methoxy group;

$W_5$–$W_8$ are independently hydrogen, alkyl, halogen, aryl, heteroaryl, alkylthio or alkoxy, with the proviso that no more than one of $W_5$–$W_8$ is alkoxy and if n' is 1, none of $W_5$–$W_8$ is aryl, or $W_6$ and $W_7$ or $W_7$ and $W_8$ can be a fused ring; and $X_3$ is S or Se.

Illustrative dyes of formnula I are:

I-1

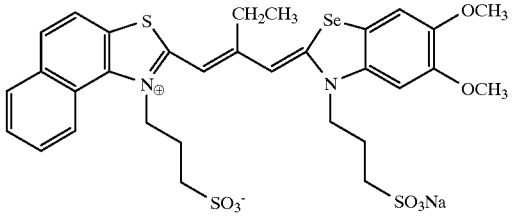

I-2

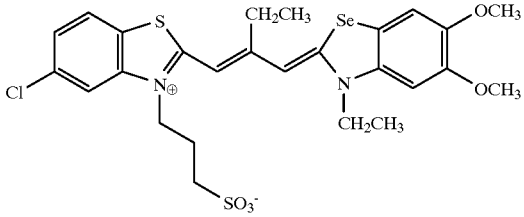

-continued

I-3

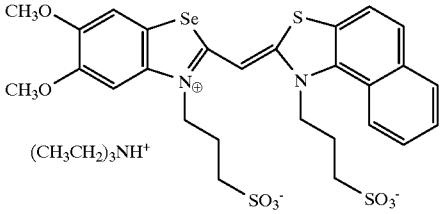

I-4

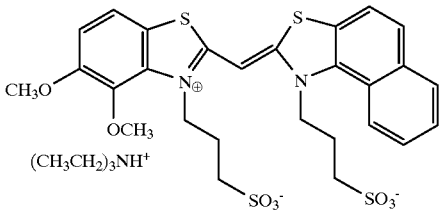

I-5

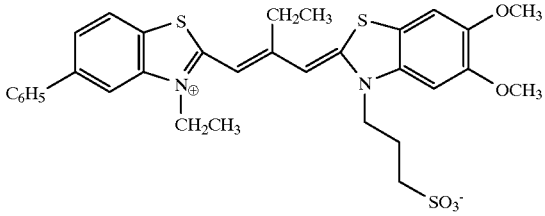

I-6

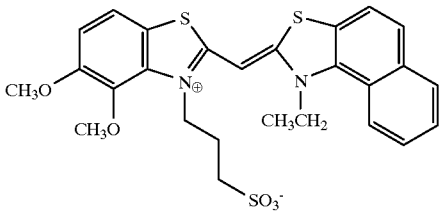

I-7

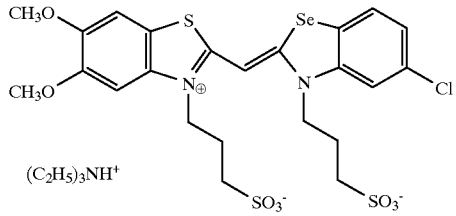

I-8

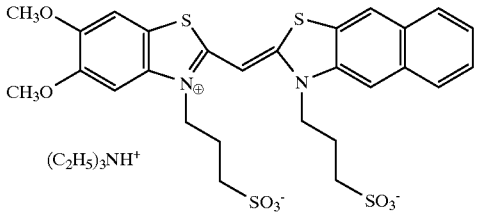

I-9

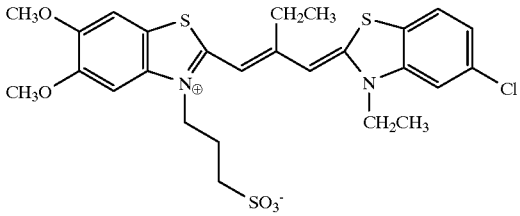

-continued
I-10
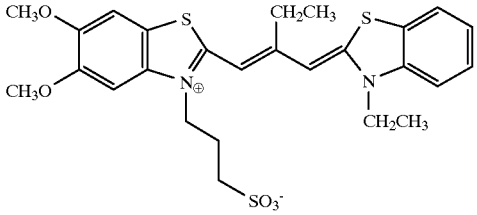
I-11
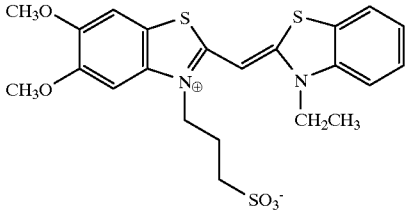
I-12
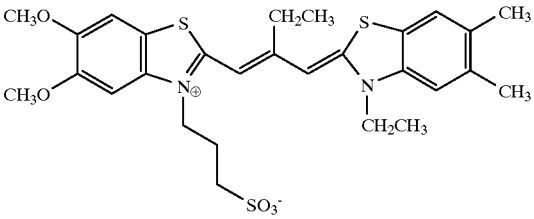
I-13
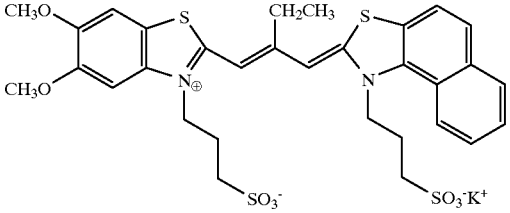
I-14
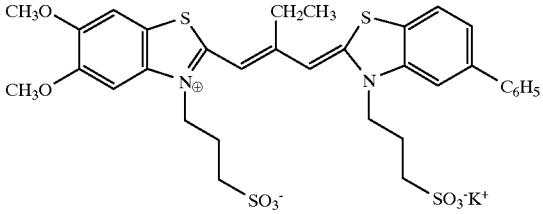
I-15
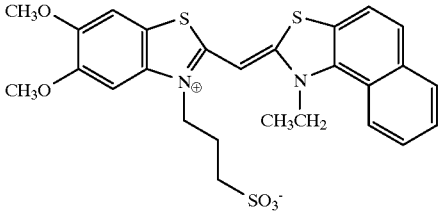
I-16
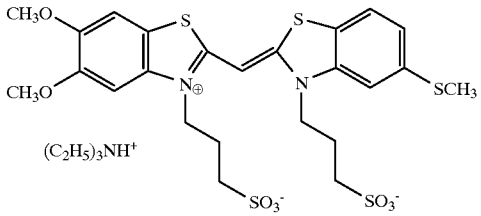
-continued
I-17
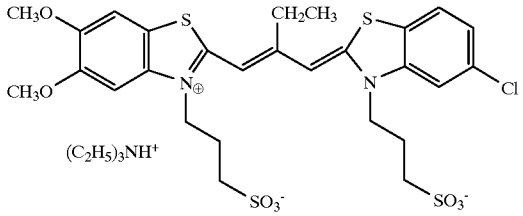
I-18
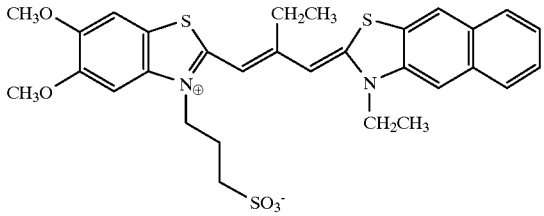
I-19
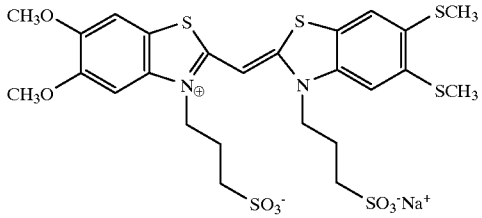
I-20
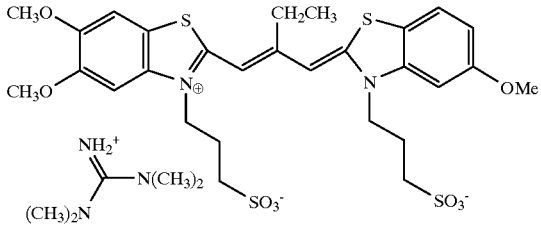
I-21
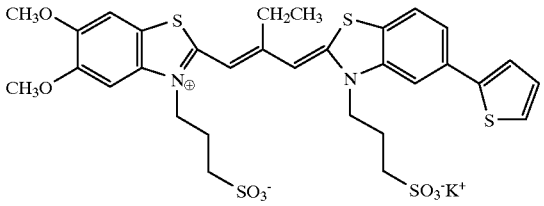
Preferred dyes of formula (II) are dyes in which n' is 1 and the center L' is substituted with an alkyl group, in particular an ethyl group.
Illustrative dyes of formula II are:
II-1
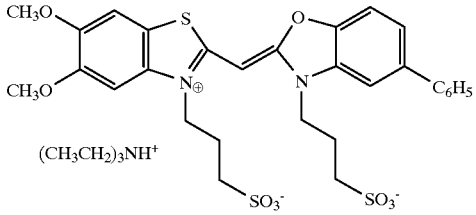

-continued
II-2
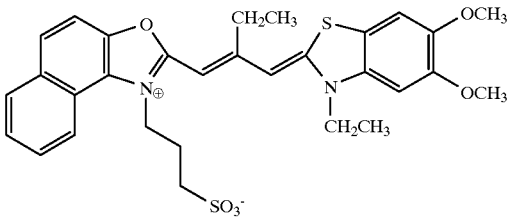
II-3
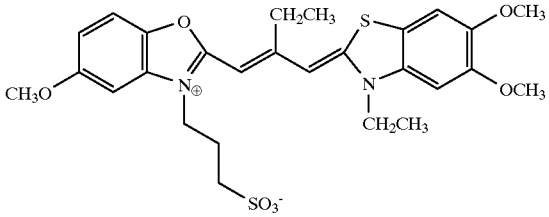
II-4
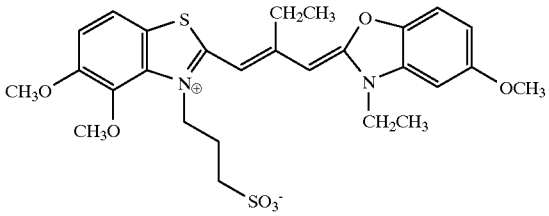
II-5
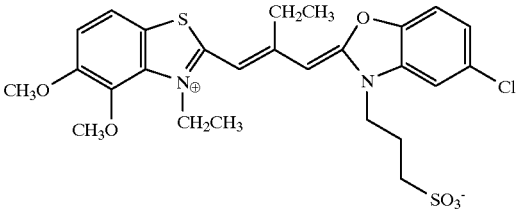
II-6
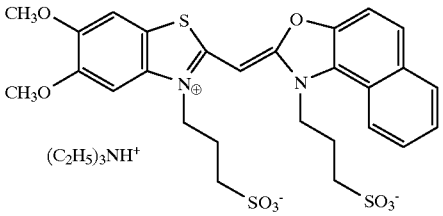
II-7
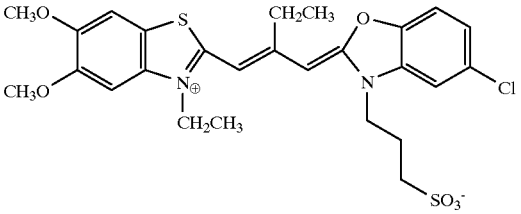
II-8
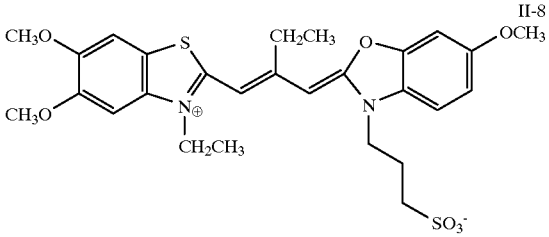
-continued
II-9
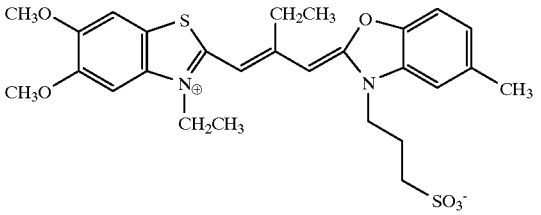
II-10
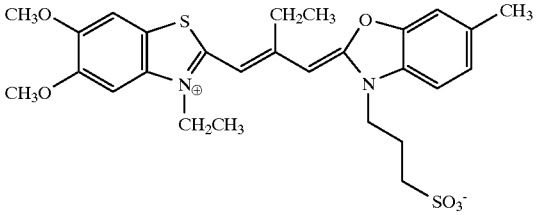
II-11
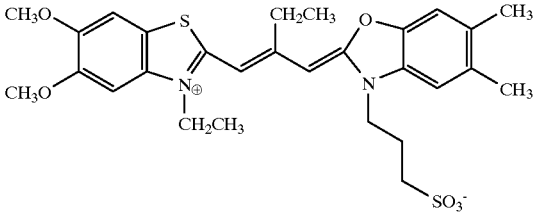
II-12
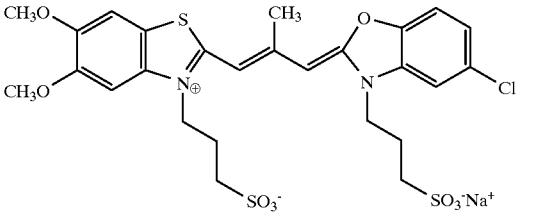
II-13
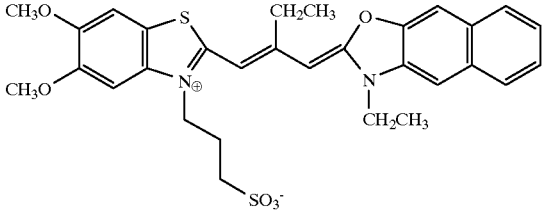
II-14
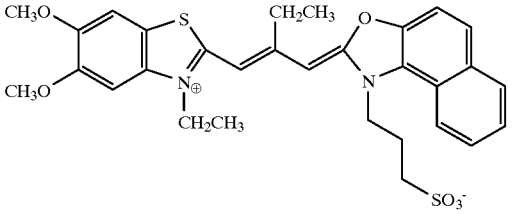
II-15
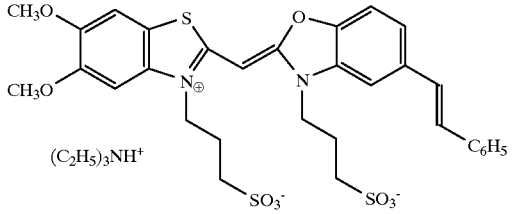

The dyes of formula (I) can be prepared by synthetic techniques well-known in the art. Such techniques are illustrated, for example, in Hamer, *Cyanine Dyes and Related Compounds*, 1964 (publisher John Wiley, & Sons, New York, N.Y.) and James, *The Theory of the Photographic Process* 4th edition, 1977 (Eastman Kodak Company, Rochester N.Y.). The amount of sensitizing dye that is useful in the invention is preferably in the range of 0.1 to 4.0 millimoles per mole of silver halide and more preferably from 0.2 to 2.2 millimoles per mole of silver halide. Optimum dye concentrations can be determined by methods known in the art.

The silver halide emulsion used in the photographic element of this invention can contain one or more additional sensitizing dyes. Among the sensitizing dyes that can be used include, for example, those disclosed in *Research Disclosure*, Sep. 1996, Number 389, Item 38957, Section V(A) the disclosure of which, including patent specifications listed therein, is incorporated herein by reference.

Reference to a light sensitive layer or a light sensitive silver halide layer, refers to such layers which are sensitive to visible light (about 400–700 nm), ultraviolet light (about 300–400 nm) or infrared light (about 700–1500 nm).

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

The emulsion layer of the photographic element of the invention can comprise any one or more of the light sensitive layers of the photographic element The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often reflected to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed. (In this case, antifogging dyes give improved $D_{max}$).

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, and silver chlorobromide and silver chloroiodobromide, wherein the silver chloride content is less than or equal to 30%.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver halide grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The following examples illustrate the use of dyes of formula I to sensitize and reduce fog in photographic elements.

PREPARATION OF EMULSION:

The following solutions were prepared:

Solution A. Sodium thiocyanate, 680 g/L

Solution B. Silver nitrate, 1.526 mole/L

Solution C. Sodium bromide, 1.442 mole/L
Potassium iodide, 0.054 mole/L

A vessel was charged with 42.4 L of a 1.24 wt % gel solution and warmed to 73 degrees C. 0.57 L of solution A was added, then 12.6 L of solution B and 14.6 L of solution C were added simultaneously at a constant rate over 35 min. An additional 1.8 L of solution B was then added over 5 min. The emulsion was then cooled to 30 degrees C. Salts were removed by three cycles of lowering the pH to precipitate the gel and decanting the solution, followed by reconstitution to pH 5.2 and the initial volume with water. After the third wash the VAg of the emulsion was adjusted to 75 by the addition of 3.86 M sodium bromide solution. 5.96 L of 9.75 wt % gelatin was added and 4-chloro-3,5-xylenol as a preservative. This produced a polydisperse, polymorphic emulsion that was 94% bromide and 6% iodide, and had an average grain size of 0.37 micron.

Chemical Sensitization. The above emulsion was chemically sensitized with 1.3 mg/Ag mole potassium tetrachloroaurate and 2.6 mg/Ag mole sodium thiosulfate pentahydrate. The thiosulfate was added at a temperature of 40° C. followed by the gold. The emulsion was then heated at a rate of 1.67 degrees/min to 65° C. and held at that temperature for 25 min before chilling at 10° C.

EXAMPLE 1

Sample 1-1 was prepared as follows. 0.013 mole of the above emulsion was dyed with 0.4 mmole/Ag mole of dye A by adding a methanol solution of the dye to the emulsion at 40 degrees C. After waiting twenty minutes, a dispersion of cyan coupler CC-1 (7 wt % coupler, 4 wt % dibutyl phthalate, 7.25% gelatin, 1wt % Alkanol XC, and propionic acid), and 2 g/Ag mole tetraazaindene were added with additional gelatin, and saponin as a coating aid.

The emulsion and coupler were then coated on gelatin subbed acetate support at a coated coverage of 150 mg silver/$ft^2$., 90 mg coupler/$ft^2$, and 450 mg gelatin/$ft^2$. Samples 1-2 through 1-21 were prepared similarly using the dyes listed in Table I. Sample 1-22 was treated with methanol solvent like sample 1-1, but no dye was added. This coating of undyed emulsion served as a reference for the dyed emulsions.

Coatings were given a 1/50 second wedge spectral exposure and processed using KODAK FLEXICOLOR C41 process as described in *Brit. J. Photog. Annual*, 1988, p196–198 with the exception that the composition of the bleach solution was changed to comprise propylenediaminetetraacetic acid.

The propensity of the dyes to restrain fog was assessed four ways.

1) The minimum density of the fresh coatings was recorded after exposure and processing as above.

2) Three sets of coatings were given increasing times of development (TOD), 2', 3'15", and 4'30" and the difference in minimum density between 2' and 4'30" was recorded.

3) One set of coatings was given accelerated aging by incubating it for 2 weeks at 100 degrees Fahrenheit and 50% relative humidity. This set was exposed and processed as above and compared to a set that was kept at room temperature for 2 weeks. The difference between the minimum density of the incubated and room temperature coatings was recorded.

4) One set of coatings was stored for 4 months at ambient temperature and humidity, then exposed and processed as above. The difference between the minimum density of the aged coatings and the fresh coatings was recorded.

These data are recorded in Table I.

The comparative dyes used in this example are:

Comparison Dyes:

TABLE I

Dye A

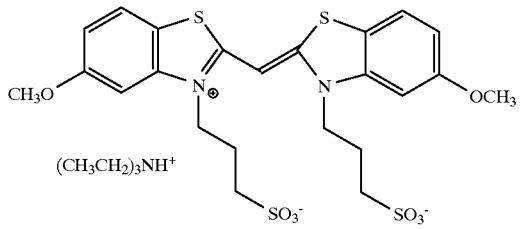

Dye B

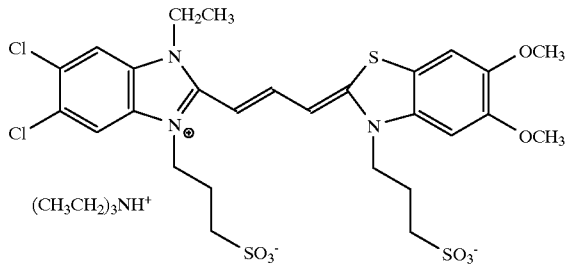

Dye C

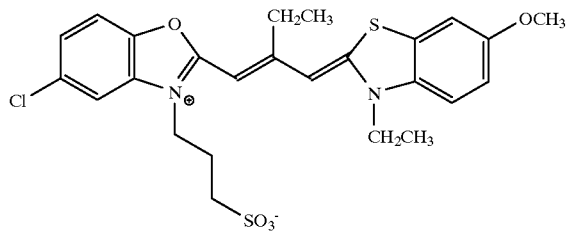

Dye D

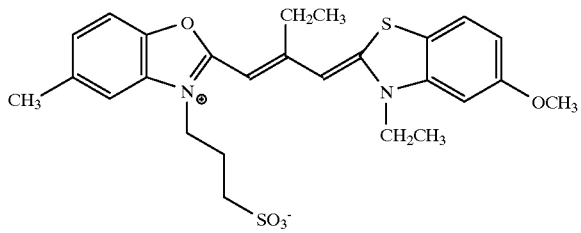

Dye E

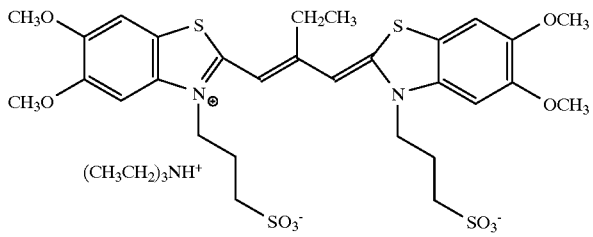

TABLE I-continued
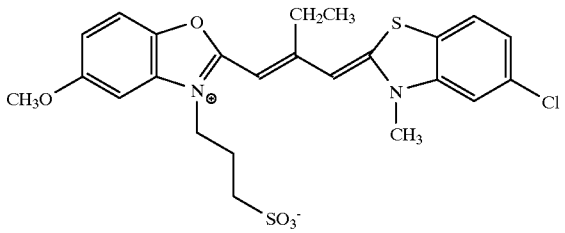
Dye F
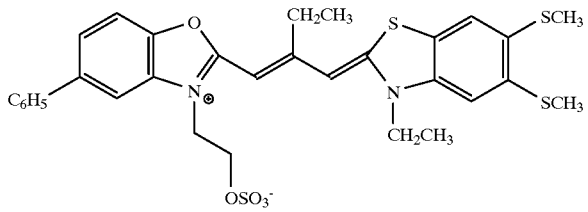
Dye G
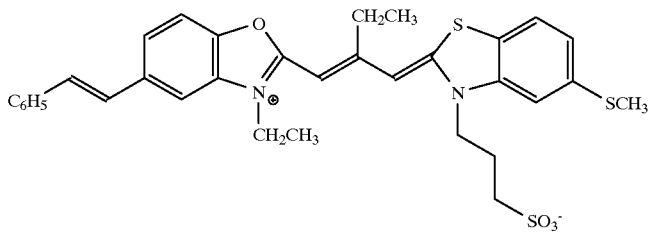
Dye H
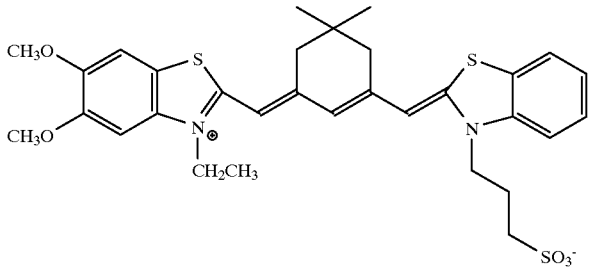
Dye J
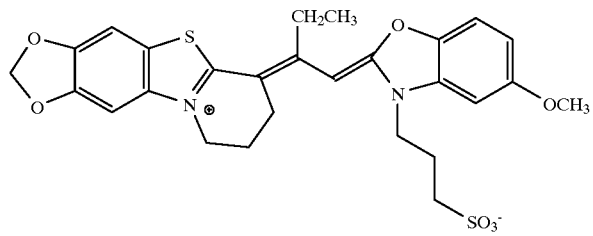
Dye K
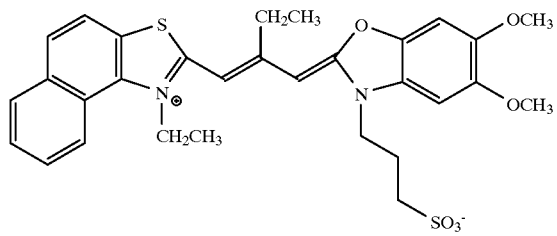
Dye L TABLE I-continued Dye M

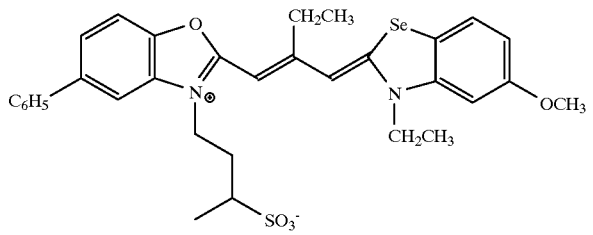

| Sample | Dye | Fresh Dmin | Δ Dmin TOD | Δ Dmin incubated - room kept | Δ Dmin 4 months - fresh | Note |
|---|---|---|---|---|---|---|
| 1-1 | A | 0.21 | 0.225 | −0.005 | 0.00 | Comp |
| 1-2 | B | 0.20 | 0.25 | 0.045 | 0.05 | Comp |
| 1-3 | C | 0.25 | 0.33 | 0.485 | 0.13 | Comp |
| 1-4 | D | 0.33 | 0.47 | 0.115 | 0.10 | Comp |
| 1-5 | E | 0.16 | 0.245 | 0.01 | 0.06 | Comp |
| 1-6 | I-1 | 0.08 | 0.09 | 0.085 | 0.03 | Inv |
| 1-7 | I-2 | 0.08 | 0.055 | 0.01 | 0.05 | Inv |
| 1-8 | II-1 | 0.11 | 0.13 | 0.015 | 0.05 | Inv |
| 1-9 | F | 0.23 | 0.295 | 0.10 | 0.13 | Comp |
| 1-10 | G | 0.18 | 0.275 | 0.075 | 0.09 | Comp |
| 1-11 | H | 0.19 | 0.175 | 0.015 | 0.05 | Comp |
| 1-12 | I-3 | 0.16 | 0.11 | 0.02 | −0.03 | Inv |
| 1-13 | J | 0.46 | 0.595 | −0.055 | −0.07 | Comp |
| 1-14 | I-4 | 0.09 | 0.04 | 0.025 | 0.02 | Inv |
| 1-15 | K | 0.74 | 0.665 | −0.01 | 0.03 | Comp |
| 1-16 | L | 0.19 | 0.25 | 0.085 | 0.13 | Comp |
| 1-17 | II-2 | 0.11 | 0.10 | 0.02 | 0.05 | Inv |
| 1-18 | I-5 | 0.11 | 0.05 | 0.005 | 0.02 | Inv |
| 1-19 | II-3 | 0.14 | 0.13 | 0.025 | 0.08 | Inv |
| 1-20 | M | 0.16 | 0.19 | 0.06 | 0.09 | Comp |
| 1-22 | none | 0.20 | 0.22 | 0.09 | 0.105 | Ref |

The dyes of the invention are seen to restrain fog in several of the tests used while being no worse for fog in any of the other tests. All dyes of the invention have less fog than the undyed reference (sample 1–22), while some comparison dyes enhance fog growth.

The invention has been described in detail with particular reference to certain preferred embodiments thereof, but it will be understood that variations and modifications can be effected within the spirit and scope of the invention.

What is claimed is:

1. A photographic element comprising at least one light-sensitive layer comprising a silver bromide or iodobromide emulsion and a dye of formula (I) or formula (II):

(I)

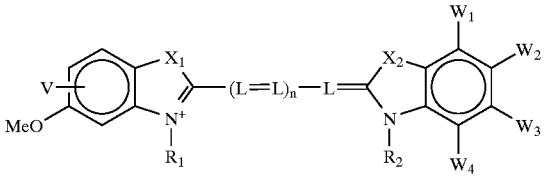

wherein:

each L is a substituted or unsubstituted methine group, n is 0 or 1;

$R_1$ and $R_2$ are substituted or unsubstituted alkyl groups;

V is a 4-methoxy or 6-methoxy group;

$W_1$–$W_4$ are independently hydrogen, alkyl, halogen, aryl, heteroaryl, alkylthio or alkoxy, with the proviso that no more than one of $W_1$–$W_4$ is alkoxy, or $W_2$ and $W_3$ or $W_3$ and $W_4$ can be a fused ring; and $X_1$ and $X_2$ are independently S or Se;

(II)

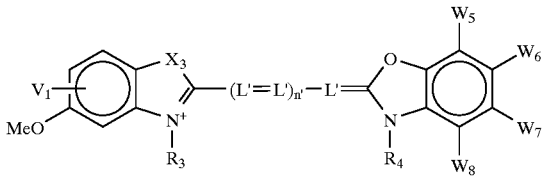

wherein:

each L' is a substituted or unsubstituted methine group, n' is 0 or 1;

$R_3$ and $R_4$ are substituted or unsubstituted alkyl groups;

$V_1$ is a 4-methoxy or 6-methoxy group;

$W_5$–$W_8$ are independently hydrogen, alkyl, halogen, aryl, heteroaryl, alkylthio or alkoxy, with the proviso that no more than one of $W_5$–$W_8$ is alkoxy and if n' is 1, none of $W_5$–$W_8$ is aryl, or $W_6$ and $W_7$ or $W_7$ and $W_8$ can be a fused ring; and $X_3$ is S or Se.

2. A photographic element according to claim 1, wherein said dye is of formula (I).

3. A photographic element according to claim 2, wherein n is 1 and the center L is substituted with an alkyl group.

4. A photographic element according to claim 3, wherein the alkyl group is ethyl.

5. A photographic element according to claim 2, wherein V is a 4-methoxy group.

6. A photographic element according to claim 1, wherein n and n' are zero in formula (I).

7. A photographic element according to claim 1, wherein the emulsion is a silver iodobromide emulsion.

8. A photographic element according to claim 2, wherein $R_1$ or $R_2$ is a sulfoalkyl group.

9. A photographic element according to claim 2, wherein each of $W_1$, $W_2$ and $W_4$ is H.

10. A photographic element according to claim 2, wherein the dye of formula (I) is selected from:

I-1

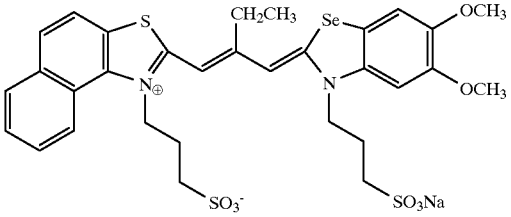

I-2

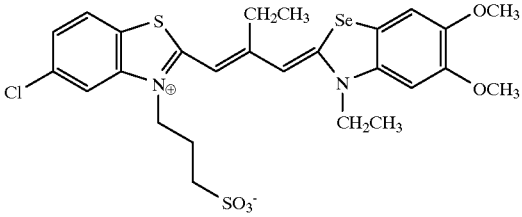

I-3

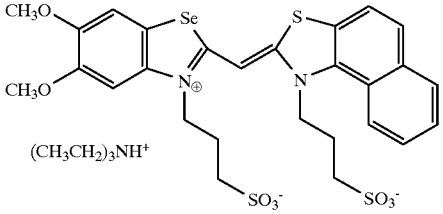

I-4

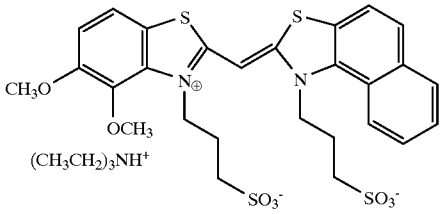

and

I-5

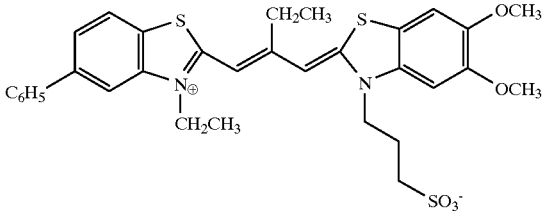

11. A photographic element according to claim 2, wherein the silver halide emulsion contains at least one sensitizing dye in addition to a sensitizing dye of formula (I).

12. A photographic element according to claim 1, wherein said dye is of formula (II).

13. A photographic element according to claim 12, wherein n' is 1 and the center L' is substituted with an alkyl group.

14. A photographic element according to claim 13, wherein the alkyl group is ethyl.

15. A photographic element according to claim 12, wherein $V_1$ is a 4-methoxy group.

16. A photographic element according to claim 1, wherein said dye satisfies formula (II).

17. A photographic element according to claim 16, wherein the silver halide is silver iodobromide.

18. A photographic element according to claim 12, wherein $R_3$ or $R_4$ is a sulfoalkyl group.

19. A photographic element according to claim 12, wherein each of $W_5$ $W_6$ and $W_8$ is H.

20. A photographic element according to claim 16, wherein the dye of formula (II) is selected from:

II-1

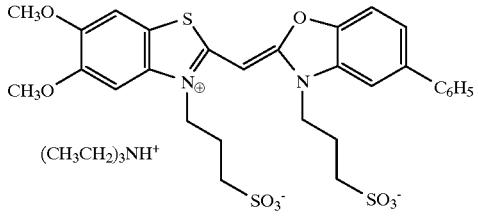

II-2

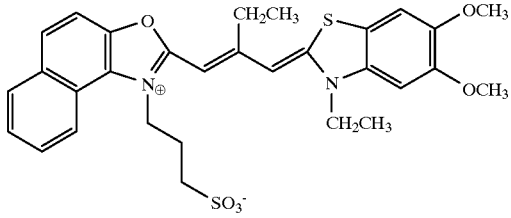

and

II-3

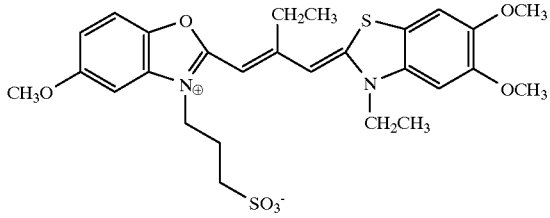

21. A photographic element according to claim 12, wherein the silver halide emulsion contains at least one sensitizing dye in addition to a sensitizing dye of formula (II).

* * * * *